US005998761A

United States Patent [19]

Berkes et al.

[11] Patent Number: 5,998,761

[45] Date of Patent: Dec. 7, 1999

[54] VARIABLE DWELL FUSER

[75] Inventors: John S. Berkes; Daniel G. Hullihen, Jr., both of Webster, N.Y.

[73] Assignee: Xerox Corporation, Stamford, Conn.

[21] Appl. No.: 09/113,270

[22] Filed: Jul. 10, 1998

[51] Int. Cl.[6] ..... H05B 1/00

[52] U.S. Cl. ..... 219/216; 219/388; 219/469; 399/328; 399/329; 399/320; 399/122; 399/67; 399/68

[58] Field of Search ..... 219/388, 469, 219/216; 399/332, 376, 329, 122, 328, 320, 67, 68

[56] References Cited

U.S. PATENT DOCUMENTS

| | | | |
|---|---|---|---|
| 3,578,797 | 5/1971 | Hodges | 263/3 |
| 3,965,331 | 6/1976 | Moser et al. | 219/216 |
| 4,223,203 | 9/1980 | Elter | 219/216 |
| 4,429,987 | 2/1984 | Chang et al. | 399/322 |
| 4,639,405 | 1/1987 | Franke | 430/124 |
| 4,791,447 | 12/1988 | Jacobs | 355/3 FU |
| 5,053,829 | 10/1991 | Fiels et al. | 355/290 |
| 5,099,288 | 3/1992 | Britto et al. | 355/290 |
| 5,250,998 | 10/1993 | Ueda et al. | 355/285 |
| 5,729,812 | 3/1998 | Moser | 399/329 |
| 5,887,235 | 3/1999 | Wayman | 399/329 |
| 5,890,047 | 3/1999 | Moser | 399/329 |

FOREIGN PATENT DOCUMENTS

| | | |
|---|---|---|
| 61-189877 | 1/1986 | Japan . |
| 63-13088 | 1/1988 | Japan . |

*Primary Examiner*—John A. Jeffery
*Assistant Examiner*—Leonid Fastovsky

[57] ABSTRACT

A variable dwell heat and pressure belt fuser for imparting selectable gloss to color toner images. A hybrid belt/roll fuser which has both a roll/roll nip and a belt/roll nip where the size of the latter can be varied by adjusting the position of the fuser roll around the axis of the pressure roll or by varying the location of the belt transport idler roll relative to the heat and pressure fuser members. For any given speed and nip pressure, the high pressure dwell between the fuser and pressure rolls is fixed but the low pressure dwell between the fuser roll and fuser belt can be varied from zero to four (or more) times the high pressure dwell in a prescribed manner.

10 Claims, 5 Drawing Sheets

VARIABLE DWELL FUSER

This invention relates generally to xerographic image creation apparatus, and more particularly, it relates to a variable dwell, heat and pressure belt fuser for imparting selectable gloss to color toner images.

In the art of xerography or other similar image reproducing arts, a latent electrostatic image is formed on a charge-retentive surface which may comprise a photoconductor which generally comprises a photoconductive insulating material adhered to a conductive backing.

When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus. To date, the use of simultaneous heat and contact pressure for fusing toner images has been the most widely accepted commercially, the most common being ones that utilize a pair of pressure engaged rolls.

The use of pressure engaged rolls for fixing toner images is well known in the art. It has been successfully demonstrated that pressure engaged fuser rolls which exhibit high nip pressures can produce high gloss color images. However, it is not desirable that all color images exhibit high gloss. Accordingly, the end user should be provided with the choice of selecting the gloss level of xerographically printed color images.

User selectable gloss can be accomplished by an increase in the fuser dwell time. Increased fuser dwell time has the advantage of enabling reduced fuser temperature for comparable fix or alternatively results in enhanced gloss at constant temperature or speed. The disadvantage of increased dwell time for roll fusers is that either the process speed must be reduced or the fuser roll diameter has to be increased beyond practical limits.

The use of multiple fuser rolls and other methods for modifying the gloss of color images is disclosed in a number of publications, for example, U.S. Pat. No. 5,099,288 granted on Mar. 24, 1992 to Britto et al. discloses an image fixing device wherein a document carrying thermoplastic toner to be fixed is held in the nip of belts where it is moved under a heater. The toner is in contact with the longer of the two belts. When a slightly rough image is desired, such as in normal printing on paper, the document is removed while the toner is still mobile and has some affinity for the belt on which it is carried. When a very smooth image is desired, such as for transparencies to be optically projected, the document is removed after the toner is cooled. Cooling is implemented by having an alterable heat sink or, alternatively, multiple removal stations.

Following is a discussion of other prior art, incorporated herein by reference, which may bear on the patentability of the present invention. In addition to possibly having some relevance to the question of patentability, these references, together with the detailed description to follow, should provide a better understanding and appreciation of the present invention.

U.S. Pat. No. 4,791,447 granted on Dec. 13, 1988 to Robert M. Jacobs discloses a heat and pressure fusing apparatus for fixing color toner images to various types of copy substrates. The apparatus includes three roll members which cooperate to form a pair of nips. All substrates pass through a first nip and a deflector plate directs certain types of substrates through the second nip. Passage of the substrates through the first nip causes the images carried thereon to contact a conformable elastomeric surface while passage through the second nip causes them to contact a relatively rigid surface. Thus, glossy and matte color copies on substrates such as plain paper and high chroma transparencies are suitably produced in a color reproduction apparatus incorporating this fuser. Matte color copies are produced by passing the substrate through only the first nip while glossy color copies and high chroma transparencies are produced by passing the substrates through both nips.

U.S. Pat. No. 4,639,405 granted to Hans G. Franke on Jan. 27,1987 discloses a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

U.S. Pat. No. 4,223,203 granted to John F. Elter on Sep. 16, 1980 discloses a heat and pressure fusing apparatus for fixing toner images to copy substrates comprising a first fusing system consisting of a pair of nip forming rolls, one of which is provided with a conformable outer surface and a second fusing system consisting of a pair of nip forming rolls, one of which has a rigid outer surface. Copy substrates are passed sequentially through the nips of the first and second fusing systems, in that order such that the toner images sequentially contact the conformable outer surface and then the rigid outer surface.

U.S. Pat. No. 3,965,331 granted to Rabin Moser on Jun. 22, 1976 discloses a contact fuser assembly for use in an electrostatic reproducing apparatus wherein toner Images are formed on various types of substrates, for example, plain paper and transparency materials such as cellulose acetate or polyester film. The fuser assembly is characterized by a provision of a plurality of fuser rolls forming a pair of nips through which the substrates pass in order to fuse the toner images thereto. Transport mechanism is provided for conveying the substrates to one or the other of the nips depending upon the particular material of the substrate. The surface of the roll provided for contacting the plain paper comprises a hard metal surface and the roll for contacting the toner images carried by the cellulose acetate, etc. comprises an elastomeric surface.

U.S. Pat. No. 3,578,797 granted to Hodges discloses the cooling of fixed images before removing the toner from contact with the surface on which it is cooled.

U.S. Pat. No. 5,250,998 granted to Ueda et al. on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller. The two nips have different pressures.

Japanese publication 63-13088 published on Jan. 20, 1988 discloses a fuser wherein glossiness of a copy image according to a user's preference is effected by varying the nip width and/or set temperature of a fuser roll.

Japanese publication No. 61-18982 published on Jan. 20, 1986 discloses a belt fuser wherein the nip or dwell time can be varied by varying the pressure contact between the belt and a heated roll.

U.S. patent application Ser. No. 07/169,836 filed on Dec. 16, 1993 discloses a fuser having three fuser rollers cooperating with a pressure roller to form an extended fusing zone through which a substrate carrying toner images passes with the toner images contacting a fusing belt. Electrical power is applied to the three fuser rolls in such a manner that the portions of the belt in a fusing zone are heated to a predetermined operating temperature in accordance with a setpoint temperature. The free extent of the belt or in other words the portion of the belt outside of the fusing zone is adapted to be heated to various operating temperatures in order to produce prints with different gloss as desired.

BRIEF SUMMARY OF THE INVENTION

The intents and purposes of the present invention are met by the provision of a fuser in which the dwell time can be instantaneously changed without changing the process speed or increasing the fuser operating temperature. The forgoing is effected using a hybrid belt/roll fuser which comprises both a roll/roll nip and a belt/roll nip where the size of the latter can be varied by adjusting the position of the fuser roll around the axis of the pressure roll. Alternatively, an idler roll supporting the belt portion of the fuser can be repositioned for establishing the belt/roll nip.

Increased fuser dwell time enables a reduced fuser operating temperature at a comparable fix or alternatively can provide an enhanced gloss at constant temperature or speed.

This hybrid roll/belt fuser has a high pressure roll/roll nip and a low pressure roll/belt nip. For any given speed and nip pressure, the high pressure dwell is fixed but the low pressure dwell can be varied from zero to four (or more) times the high pressure dwell by varying the location of the belt transport idler roll. Alternatively, this variable low pressure dwell is achieved by swinging the fuser roll about the pressure roll axis.

DETAILED DESCRIPTION OF THE PREFERRED EMBODIMENT OF THE INVENTION

Figure 1:
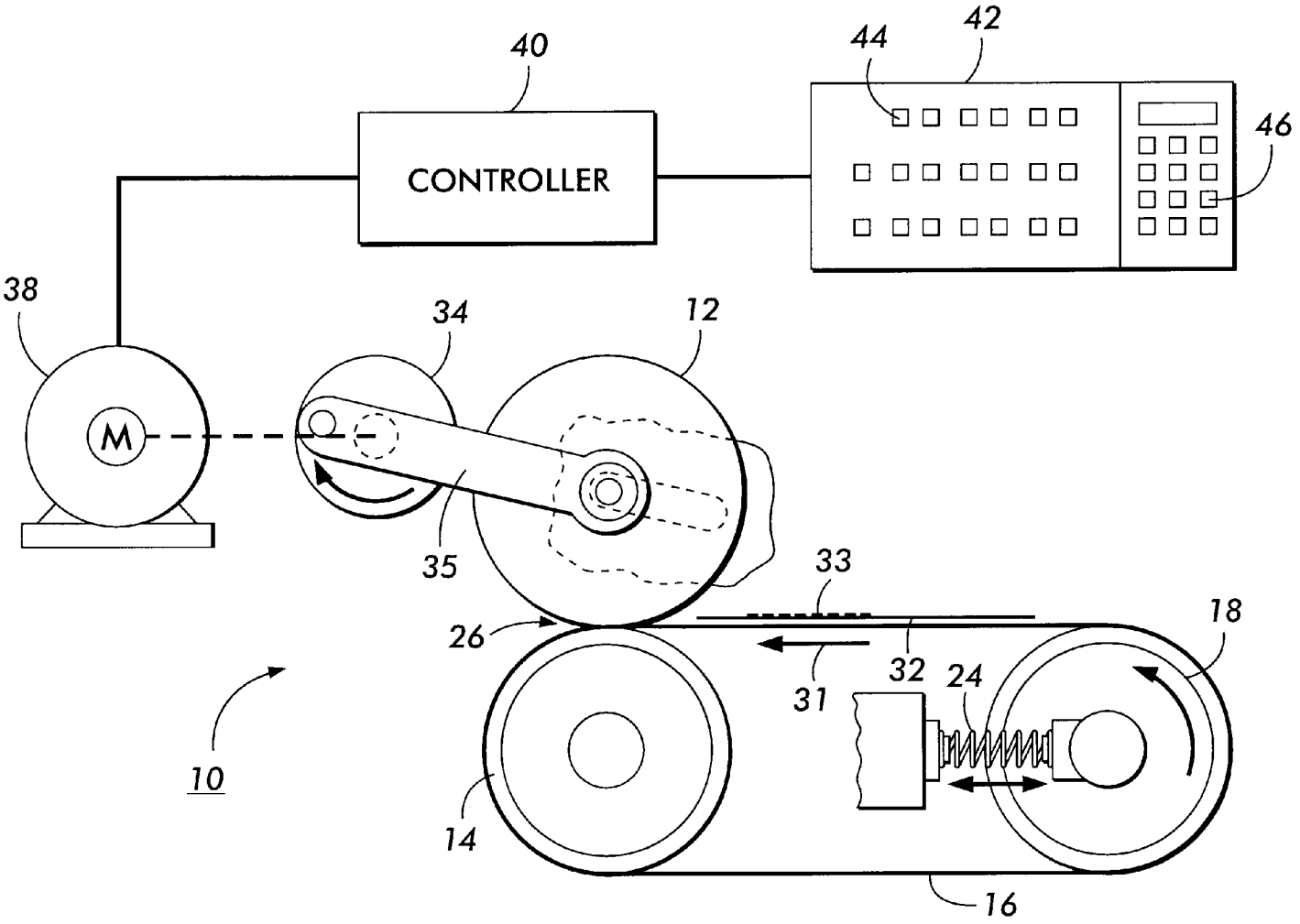
FIG. 1 discloses a schematic representation of belt and roll fuser having a high pressure nip with a fixed dwell time to be used in one mode of operation.

While the present invention will hereinafter be described in connection with at least two embodiments, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

As shown in FIG. 1, a heat and pressure belt fuser 10 according to the invention comprises an internally heated fuser roll member 12 and a backup or pressure roll member 14. A belt member 16 is supported for movement in an endless path by the pressure roll 14 and an idler roll 18.

Such a fuser was constructed using a heat and pressure roll fuser from a 1065™ machine. For this purpose the rubber was stripped from the 1065™ pressure roller to form the pressure roll 14. A short (i.e. approximately 12 inches in circumference) belt 16 was placed over and transported around the pressure roller 14 and the idler roll 18. The belt consisted of a 0.003 inch carbon loaded KAPTON™ substrate 22 with a 0.003 inch carbon loaded VITON™ overcoat 22. A spring member 24 served to apply a load to the idler roll 18 for effecting the desired tensioning of the belt about the pressure roll 14 and idler roll 18.

In one mode of operation, as viewed in FIG. 1, the fuser roll and pressure roll with the belt disposed therebetween are urged into pressure engagement to form a high pressure nip 26. In this mode of operation only a high pressure nip is utilized which is useful for fusing color toner images on opaque substrates.

Figure 2:
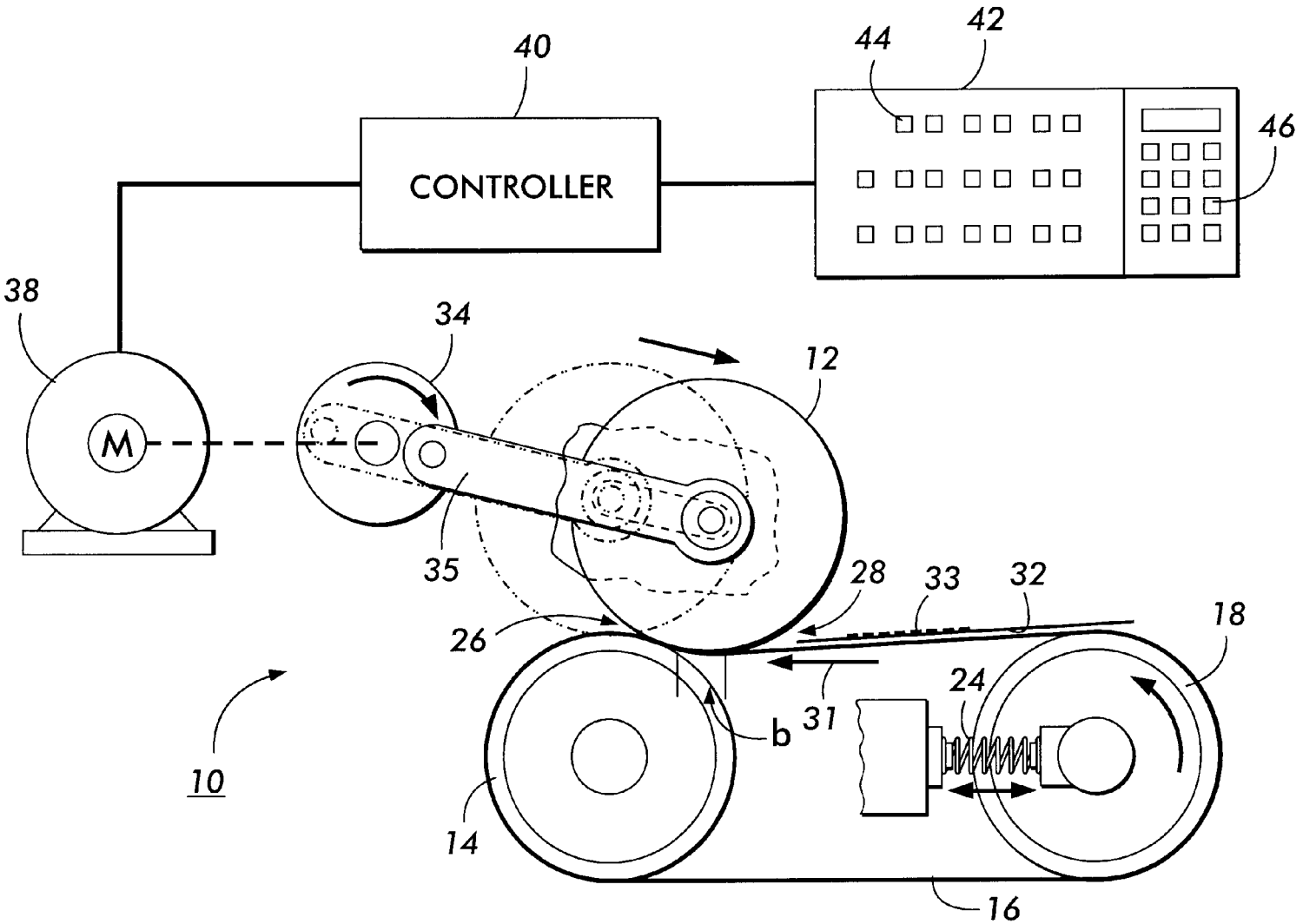
FIG. 2 is a schematic illustration of the fuser of FIG. 1 depicting a high pressure nip and a low pressure nip to be used in another mode of operation.

In another mode of operation, as viewed in FIG. 2, a low pressure nip 28 is formed between the heated fuser roll 12 and a portion of the belt member 16. The low pressure nip 28 is effected through repositioning of the heated fuser roll as shown.

Figure 3:
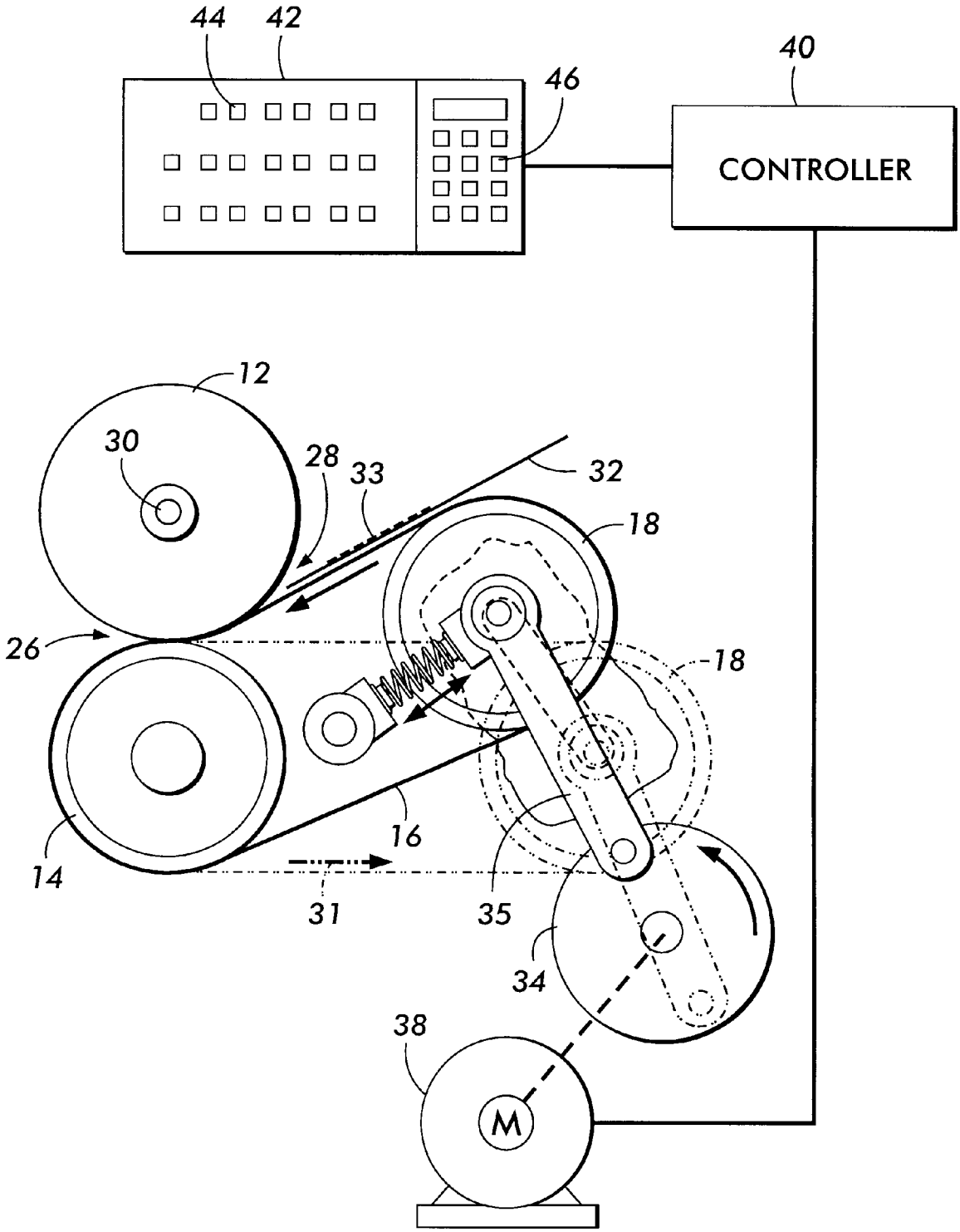
FIG. 3 is a schematic illustration of another embodiment of a roll and belt fuser with high pressure, and a low pressure nips which are effected in a manner different from the way in which they are effected in the embodiment of FIG. 2.

As shown in FIG. 3, the low pressure nip 28 can also be formed through the repositioning of the idler roll 18. This mode of operation which provides longer dwell times is more suitable for fusing color toner images on transparencies.

A quartz lamp 30 or any other suitable heat source is provided internally of the heated fuser roll 12 for elevating the fuser temperature an operating temperature of about 360 to 400° F.

The belt moves in an endless path in the counterclockwise direction as indicated by the arrow 31. A substrate 32 carrying toner images 33 is also moved in the direction of the arrow 31 in order to pass through one or more fusing nips depending on the mode of operation. When both the low and high pressure nips are utilized a substrate carrying color toner images moves through the low pressure nip first.

Reduction to practice of the disclosed invention was carried out at a 5.5 in/sec process speed with the high pressure and low pressure dwell times set to about 25 milliseconds. It is contemplated that the low pressure dwell time may be as long as 100 milliseconds.

Figure 4:
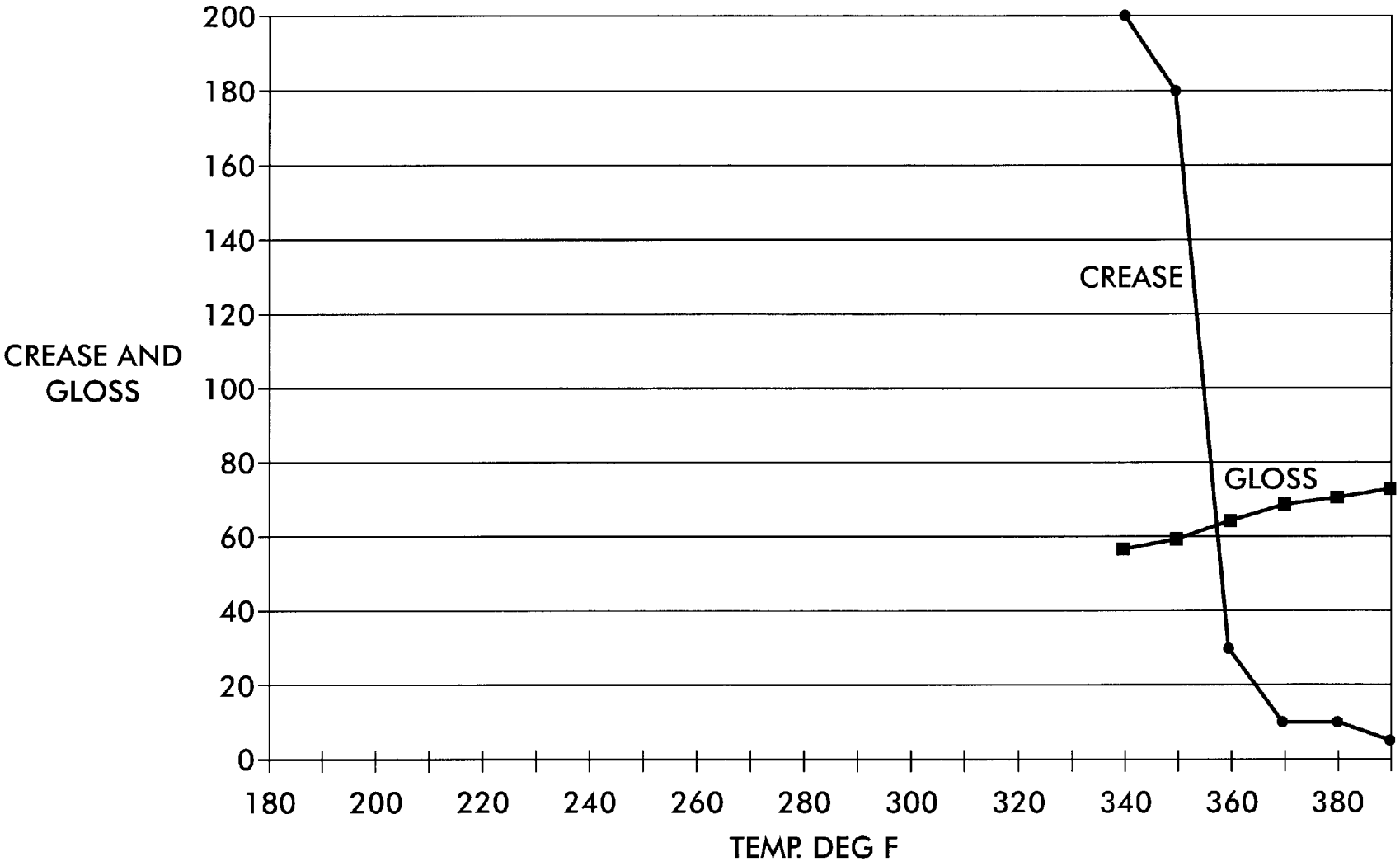
FIG. 4 is a plot of gloss/crease vs. fuser temperature for the fuser of FIG. 1.
Figure 5:
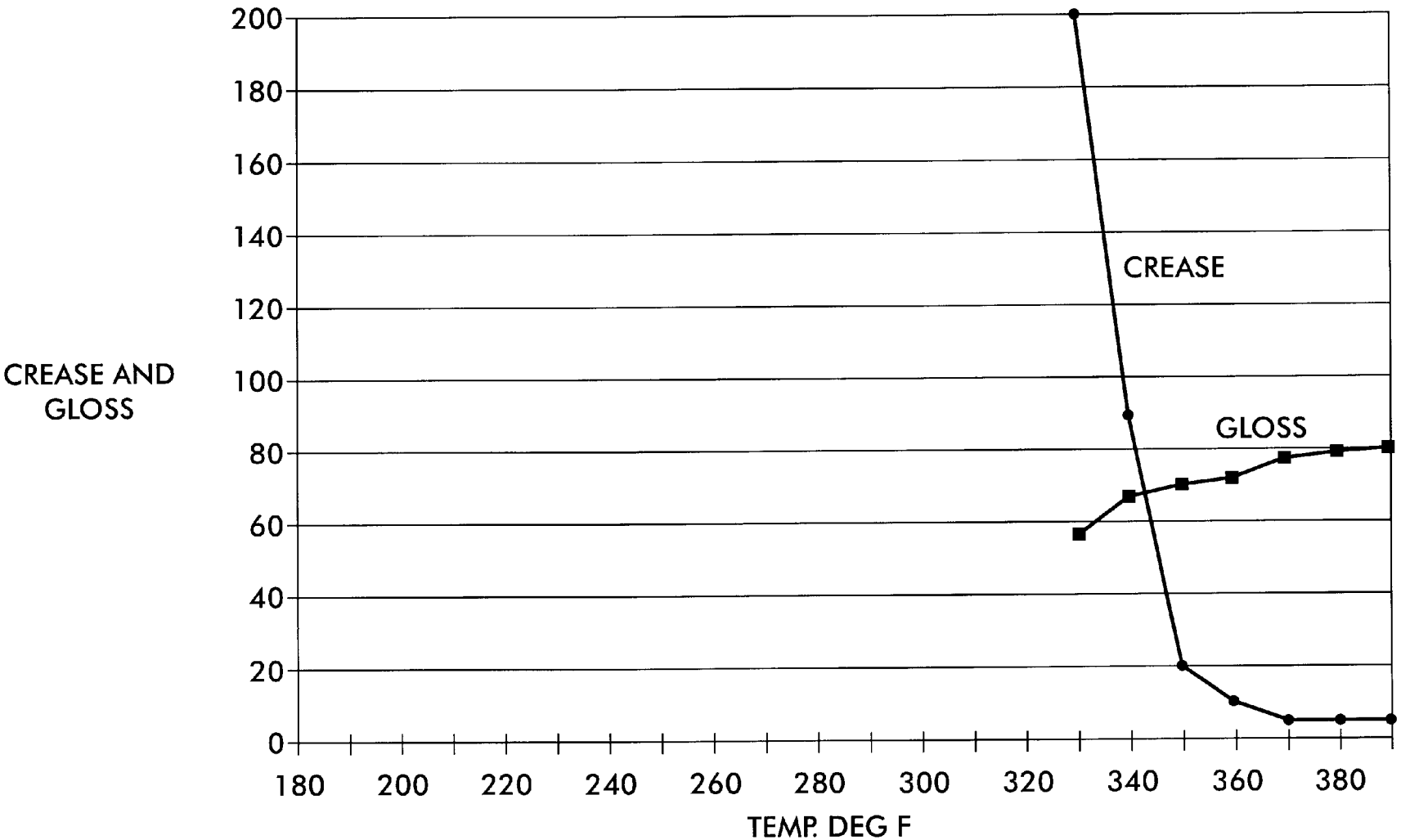
FIG. 5 is a plot of gloss/crease vs. fuser temperature depicting image gloss and crease shift for the fuser illustrated in FIG. 2.

Fusing experiments carried out using a 25 ms high pressure dwell time in combination with a 25 ms low pressure dwell showed a 20 degree shift in both the crease and the gloss curves compared to only using the 25 ms high pressure dwell. Alternatively the gloss curve is shifted up by about 10 gloss units for the combined high/low pressure nip relative to the high pressure nip alone. The data supporting the forgoing is shown in FIGS. 4 and 5.

Some of the testing with this fuser was directed towards quantifying the conditions under which it would not produce image disturbance due to vapor pressures created in the fusing nips. The results indicate that for a belt tension of about one pound per linear inch and a fuser roll temperature of 390° F. a low pressure nip of 25 ms duration does not result in image disturbance on either coated or uncoated papers under "A Zone" conditions (80° F. & 80 Relative Humidity). Higher belt tension will enable longer low pressure dwell times. Winter time lab ambient (72° F. & 15 Relative Humidity) appears to enable a slightly higher low pressure dwell time.

A suitable force applying device such as a cam 34 and cam follower arm 35 is provided for effecting the correct operating position of the heated fuser regardless of the mode of operation. FIG. 1 depicts the operational mode of the disclosed fuser where only the high pressure nip 26 is established. In this mode of operation the cam and cam follower arrangement has not been actuated. When actuated the cam moves the fuser roll to the position shown in FIG. 2 which movement opposes fuser bias members, not shown.

Rotation of the cam 34 is effected with a motor 38 operatively connected to a controller 40. In addition to controlling the operation of the cam 34, the controller 40 also controls various other machine functions. The controller 40 preferably comprises a conventional, programmable microprocessor. It is operably connected to a user interface (UI) 42 which provides operator interface via buttons 44 and 46 for varying machine operating functions. By way of example, the buttons 44 are provided for selecting the number of copies to be produced. The buttons 46 are provided for controlling various other machine functions, one of which, is the selection of a desired mode of operation which translates to a nip arrangement in accordance with the type of toner and copy substrate being utilized, A similar cam, cam follower and motor controlled by the controller can be utilized to effect movement of the idler roll instead of the heated fuser roll for effecting a low pressure nip together with a high pressure nip.

As now may be appreciated, the fuser disclosed controls image gloss without loss of throughput speed, such gloss control resulting from the variable dwell nip feature of the fuser.

It is also possible to produce an extended nip by operating the fuser in the reverse direction with the high pressure nip first followed by the low pressure nip.

What is claimed is:

1. A combination heat and pressure fuser, said fuser comprising:

a heated fuser roll;

a fuser belt;

a pressure roll supported for pressure engagement with said fuser roll through said fuser belt;

an idler roll cooperating with said pressure roll for operatively supporting said fuser belt for movement in an endless path;

a repositioner for moving one of said rolls from a first axial position to a second axial position, the first axial position resulting in a first nip pressure between the fuser roll and the fuser belt and the second axial position resulting in a second nip pressure between the fuser roll and the fuser belt.

2. A heat and pressure fuser according to claim 1 wherein said repositioner comprises means cooperating with said heated fuser roll for effecting movement thereof from said first axial position to said second axial position for forming said first and second pressure nips.

3. A heat and pressure fuser according to claim 1 wherein said repositioner comprises means cooperating with said idler roll for effecting movement thereof from said first axial position to said second axial position for forming said first and second pressure nips.

4. A heat and pressure fuser according to claim 2 wherein said first and second pressure nips take place in the same fusing operation.

5. A heat and pressure fuser according to claim 3 wherein said first pressure nip is a high pressure nip and the second pressure nip is a plurality of low pressure nips.

6. A method of fusing toner images on various substrates, said method including the steps of:

operating a heat and pressure fuser including a heated fuser roll, a fuser belt, a pressure roll supported for pressure engagement with said fuser roll through said fuser belt, and an idler roll cooperating with said pressure roll for operatively supporting said fuser belt for movement in an endless path; and moving one of said rolls from a first axial position to a second axial position, the first axial position resulting in a first pressure nip between the fuser roll and the fuser belt and the second axial position resulting in a second pressure nip between the fuser roll and the fuser belt, wherein the first and second pressure nips exert different pressures.

7. The method of fusing toner images on various substrate according to claim 6 wherein said second pressure nip is effected through movement of said heated fuser roll relative to said pressure roll.

8. The method of fusing toner images on various substrate according to claim 6 wherein said second pressure nip is effected through movement of said idler roller relative to said fuser roll.

9. The method of fusing toner images on various substrate according to claim 7 wherein said fuser roll moves in a plurality of axial positions for forming a plurality of pressure nips having different dwell times.

10. The method of fusing toner images on various substrate according to claim 8 wherein said idler roll moves in more than two axial positions for forming more than two pressure nips having different dwell times.

* * * * *